US008477563B2

(12) United States Patent
Al Abdeen

(10) Patent No.: US 8,477,563 B2
(45) Date of Patent: Jul. 2, 2013

(54) DEVICE FOR ANNOUNCING PRAYER TIMES

(76) Inventor: Adel Jumah Al Abdeen, Fahad Al-Alhmed (KW)

( * ) Notice: Subject to any disclaimer, the term of this patent is extended or adjusted under 35 U.S.C. 154(b) by 0 days.

(21) Appl. No.: 13/584,130

(22) Filed: Aug. 13, 2012

(65) Prior Publication Data

US 2013/0083632 A1 Apr. 4, 2013

Related U.S. Application Data

(63) Continuation of application No. 13/252,094, filed on Oct. 3, 2011, now abandoned.

(51) Int. Cl.
*G04B 47/00* (2006.01)

(52) U.S. Cl.
USPC ..... 368/10

(58) Field of Classification Search
USPC ..... 368/10, 12, 14, 15, 17, 21–22, 28–29
See application file for complete search history.

(56) References Cited

U.S. PATENT DOCUMENTS 5,521,887 A * 5/1996 Loomis ..... 368/47
6,202,035 B1 * 3/2001 Lameer ..... 702/178
2006/0007047 A1 * 1/2006 Dawson et al. ..... 343/702
2006/0083113 A1 * 4/2006 Shebani ..... 368/47
2010/0316238 A1 * 12/2010 Sato et al. ..... 381/300

FOREIGN PATENT DOCUMENTS

FR 2638860 A1 * 5/1990
GB 2129171 A * 5/1984

OTHER PUBLICATIONS

Prior art cited in parent U.S. Appl. No. 13/252,094, filed Oct. 3, 2011, the priority of which is claimed herein.

* cited by examiner

*Primary Examiner* — Edwin A. Leon
(74) *Attorney, Agent, or Firm* — Richard C. Litman

(57) ABSTRACT

The device for announcing prayer times provides for announcement of Muslim prayer times by recitation of athan throughout a large but localized area, e.g., a large office building or structure, a school or hospital, or a public transportation terminal, stadium, mall, etc. The device includes a single geographically fixed central unit initially programmed according to local geographical area and calendar to provide accurate output of the specific times for Muslim prayer, which are based upon the angle of the sun. While the sun angles for prayer remain constant, prayer times vary according to calendar. The central unit transmits cable or wireless audio signals to a geographically fixed auxiliary unit that transmits signals to one or more remote speakers. The central unit includes a clock display, and may include a radio and/or television receiver and/or DVD player providing output to a video screen to display various programs and messages.

16 Claims, 5 Drawing Sheets

DEVICE FOR ANNOUNCING PRAYER TIMES

CROSS-REFERENCE TO RELATED APPLICATIONS

This is a continuation of my prior application Ser. No. 13/252,094, filed Oct. 3, 2011, now pending.

BACKGROUND OF THE INVENTION

1. Field of the Invention

The present invention relates to audio and video annunciator and notification systems, and particularly to a device for announcing prayer times that combines an automated call to prayer for Muslims with an audio and video player for presentations over a geographically fixed localized area.

2. Description of the Related Art

The term "athan" means the traditional periodic call to prayer for devout Muslims, and particularly an Islamic text used to call Muslims to prayer. This word may have alternative spellings in the English language, e.g., "adhan," "azan," or similar spellings. The term "athan" is used consistently herein, but it will be understood that other spellings having essentially the same intended meaning are equivalent. The athan is an important part of the observant Muslim's life. Devout Muslims are obligated to pray at certain times during the day, and are expected to note the appropriate times accordingly. The five daily prayers include an early morning prayer, a noon prayer, a mid-afternoon prayer, a sunset prayer, and an evening prayer. The specific times for these prayers will vary in different geographic regions and with the time of the year according to the position of the sun, which makes it even more difficult for the devout Muslim to observe these times accurately.

Traditionally, in Muslim countries, a muezzin (a person who issues the call to prayer) would ascend the minaret, which is a tall tower incorporated into or adjoining a mosque, and recite the athan to call Muslims to prayer shortly before the designated time of prayer. Although muezzins still exist, often the call to prayer is announced by a recording broadcast by loudspeakers mounted on a minaret or the top of a multistory building so that the call to prayer sounds out over the rooftops. In non-Muslim countries, reliance is placed on printed prayer charts, computer programs, and Muslim Web sites that provide the precise prayer times for any date and location. Nevertheless, such devices are not always reliable. Computer programs, for example, require that the computer be powered on at all times, and are subject to failure from power outages, power surges, and other events that may stop or interrupt execution of the Athan software program.

Thus, a device for announcing prayer times solving the aforementioned problems is desired.

SUMMARY OF THE INVENTION

The device for announcing prayer times is configured to provide an athan, or Muslim call to prayer, throughout a relatively large but geographically fixed localized area, such as a public transportation terminal, an office building or structure, a mall, a school or hospital, etc. The system includes a programmable central or base unit having a database programmed specifically for the local geographic area and calendar. The central unit also contains programming to determine the specific times for prayer according to the local geographic area and the date, as the prayer times are based upon the angle of the sun and the times vary depending upon the specific geographical location and date. Since the system is intended to remain essentially permanently in the same location once it has been installed, there is no need for continuing input of geographic location (e.g., via UPS, etc.) after the system has been programmed with such geographic location data at the time of installation. A clock display is also provided. A backup power supply provides the required reliability.

The central or base unit communicates with an auxiliary unit displayed upon a wall sconce or the like as a decorative display. The communication may be by means of an electrical cable or wireless signal, or some combination thereof. The auxiliary unit communicates with one or more (preferably several) remotely located speakers distributed throughout the area or structure to provide the necessary audible notification. The speakers may be powered from the local electrical power grid, or may contain independent electrical battery power and means for recharging from the grid. The signal from the central unit may be transmitted to the remote speakers by cable or wireless means (e.g., Bluetooth®). Where a wireless system is used, the antennae may take the form of miniature minarets atop the central unit. A video display screen may also be provided for displaying religious or other messages as desired. The system may include a DVD player or the like, and/or a radio and/or television receiver having speakers and/or a video display screen used to broadcast programming from the DVD, radio receiver, and/or television receiver.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The device for announcing prayer times provides for broadcasting athan, or announcement of Muslim prayer times, throughout a fixed, localized geographical area. The system may also include audio and video players and/or radio and television receivers as well. The system includes a single, centralized base unit that sends out appropriate signals to one or more remotely situated speakers to provide athan throughout the local area.

Figure 1:
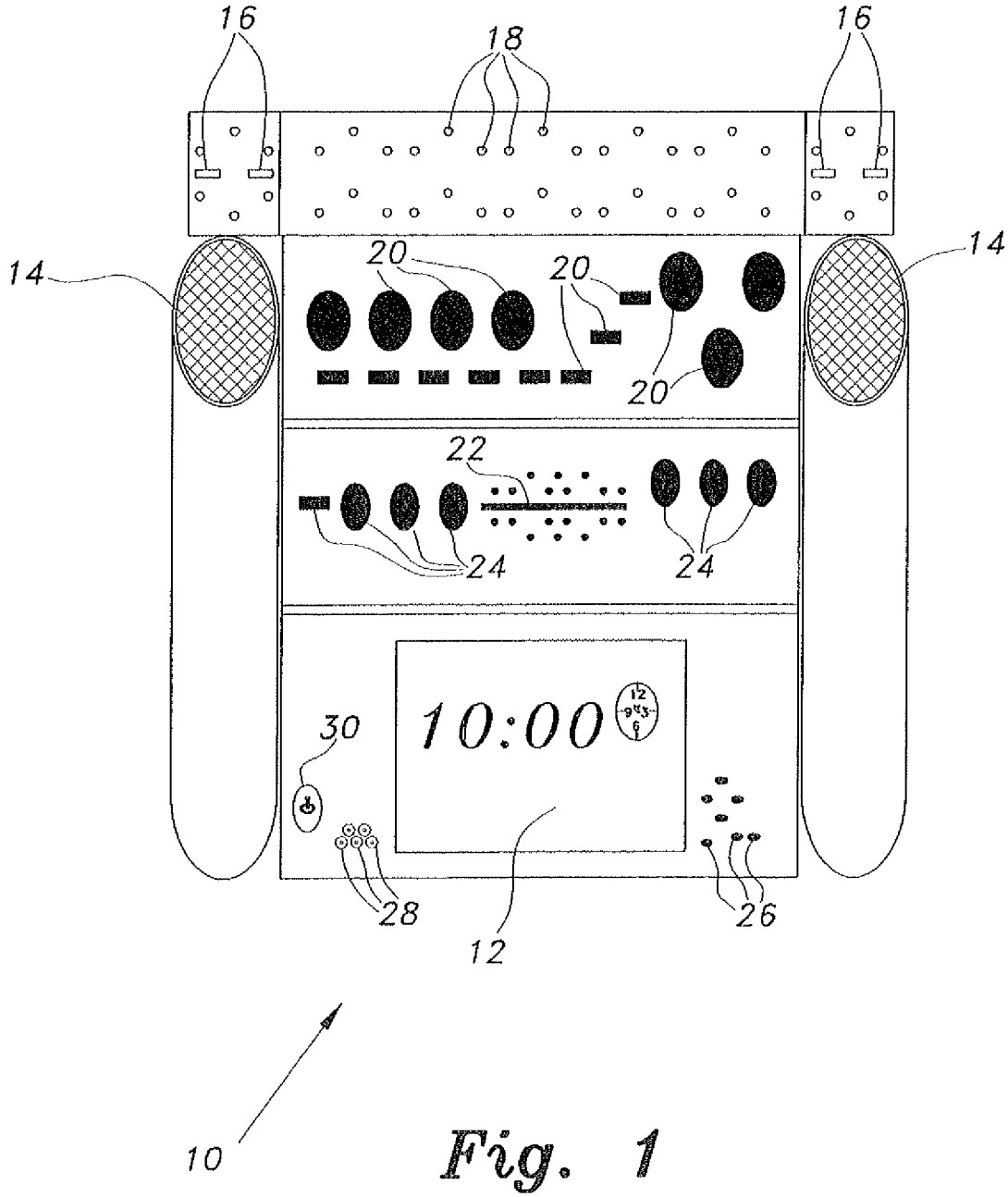
FIG. 1 is a front elevation view of the central or base unit of a device for announcing prayer times according to the present invention, illustrating various features thereof.

FIG. 1 of the drawings provides a front view of the geographically fixed base unit 10, showing various features on the front face thereof. The base unit 10 includes a computer or other programmable electronic device (a microcontroller circuit, a digital signal processor circuit, a programmable logic controller, etc.) disposed within the base unit 10, the computer or other programmable electronic device being a conventional programmable unit. As the computer is conventional, no further detail need be shown and described. The computer is initially programmed with the fixed local geographic location of the base unit 10, e.g., latitude and longitude or other means of defining the specific location of the base unit 10. As the local times of sunrise, sunset, and various predetermined angular elevations of the sun vary according to geographic location, the programming of the internal computer of the base unit 10 with its fixed and unvarying geographic position eliminates this variable that affects athan. The computer is also programmed with georeference data relating to the relative elevation of the sun at various times of the year, as the time of sunrise, sunset, and various predetermined elevations of the sun will vary according to the season. In this manner, the internal computer of the base unit 10 is capable of determining the local time when certain predetermined elevations of the sun occur, and provide a signal of the corresponding athan time.

The front face or panel of the base unit 10 includes a clock and programming display 12 thereon, with this display normally displaying the local time. The clock or time display may include both digital and analog indications, as desired. The display 12 is also used for programming the device according to the date and time, with the appropriate data being displayed during the programming operation as is conventional in the art. When the programming has been completed, the display reverts to a display of the local time.

The base unit 10 also includes a pair of audible annunciators or speakers 14 therewith, for providing athan to persons within hearing distance of the device. The audio speakers 14 are actuated by the internal computer of the device, according to the programming described further above. While only a single speaker or annunciator 14 may be provided, the provision of two such speakers 14 in a laterally symmetrical array is more esthetically pleasing as well as providing better sound distribution. Additional speakers or annunciators are remotely disposed from the base unit 10 and communicate therewith, as described further below.

The base unit 10 serves as the master control unit for the system. Accordingly, the base unit 10 includes a number of programming and other controls therewith. Beginning near the top of the base unit 10, the unit includes a series of flash drive receptacles or ports 16 to permit geographical, seasonal, temporal, and perhaps additional data to be input to the conventional internal computer without need for laboriously entering the data by means of a keyboard or the like. A field of decorative lights 18 (LEDs, etc.) may be provided across the upper portion of the front face of the base unit 10, if so desired. Alternative programming means is provided by a series of controls 20 (pushbuttons or knobs, etc.) disposed between the two speakers or annunciators 14, below the lights 18.

A CD or DVD player or deck is provided immediately below these alternative controls 20, with the player having a disc insertion slot or receptacle 22 and a series of dedicated controls 24 (e.g., track, volume, bass and treble, balance, etc.) therewith. The CD or DVD player enables the audio and/or video output of the system to be customized as desired, e.g., religious messages or programming, relatively non-volatile information such as transportation schedules, safety messages, etc. as desired.

Finally, a series of controls 26 (e.g., pushbuttons, etc.) and input jack receptacles 28 are provided adjacent to and to either side of the clock display 12. A logo or other symbol 30 may also be provided in this area for decorative and/or identification purposes, if so desired.

Figure 2:
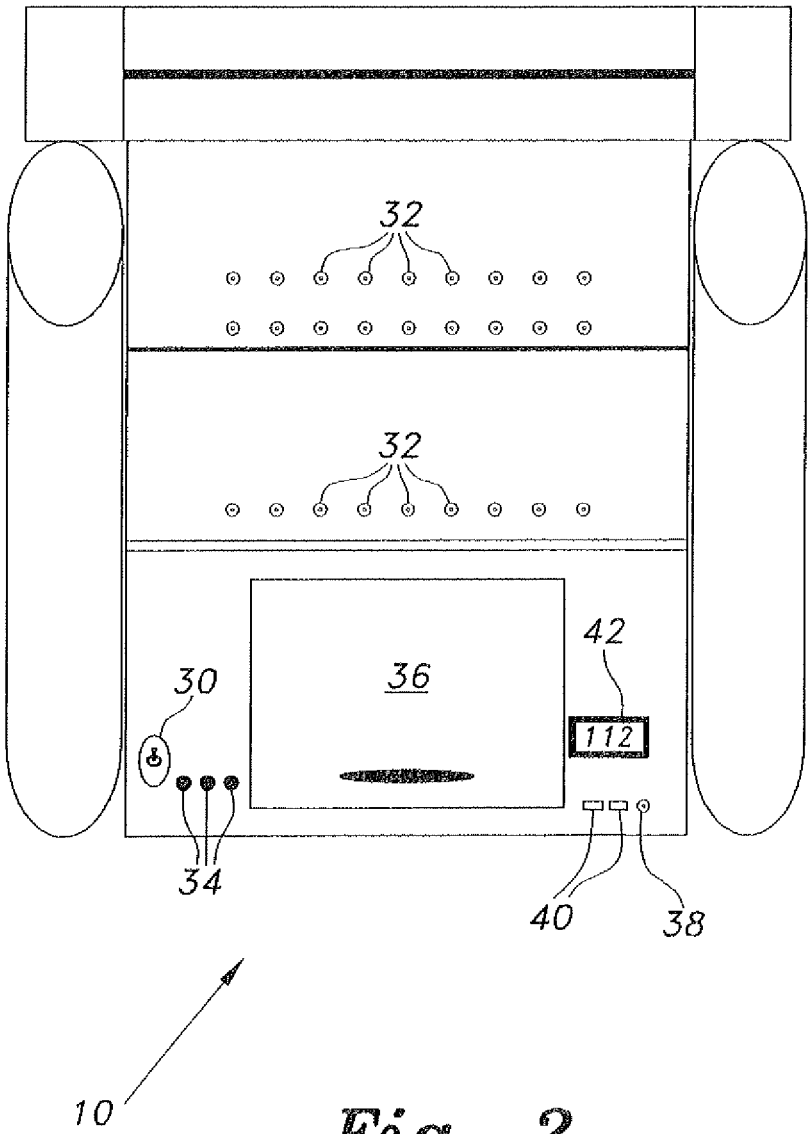
FIG. 2 is a rear elevation view of the central or base unit of FIG. 1, illustrating further features thereof.

FIG. 2 of the drawings provides a rear elevation view of the base unit 10. The upper portion of the rear panel, i.e., the area directly behind the various controls 20 on the front face or panel, includes a series of speaker output jack receptacles 32. These provide for hard wired connections to a corresponding series of remotely located audio speakers, with the arrangement being generally in accordance with FIG. 5 and discussed further below. Alternatively, the remote speakers may receive their audio signals by means of a wireless signal, if so desired. Such an arrangement is discussed further below.

The rear panel of the base unit 10 may include additional controls, input and output receptacles, access, etc., as required. Additional controls 34 (e.g., pushbuttons, etc.) may be provided in the area of the lower left corner of the rear panel, with another logo 30 adjacent thereto. An access door or hatch 36 is provided in the lower center of the rear panel of the base unit 10, for battery access and other purposes as needed. A receptacle 38 for conventional AC power is provided to the lower right portion of the rear panel, generally opposite the controls 34. Additional input receptacles 40 (flash drive, RS-232, etc.) are provided adjacent the AC power receptacle. Finally, an area is provided for a model and/or serial number 42 on the rear panel or surface of the base unit 10.

Figure 3:
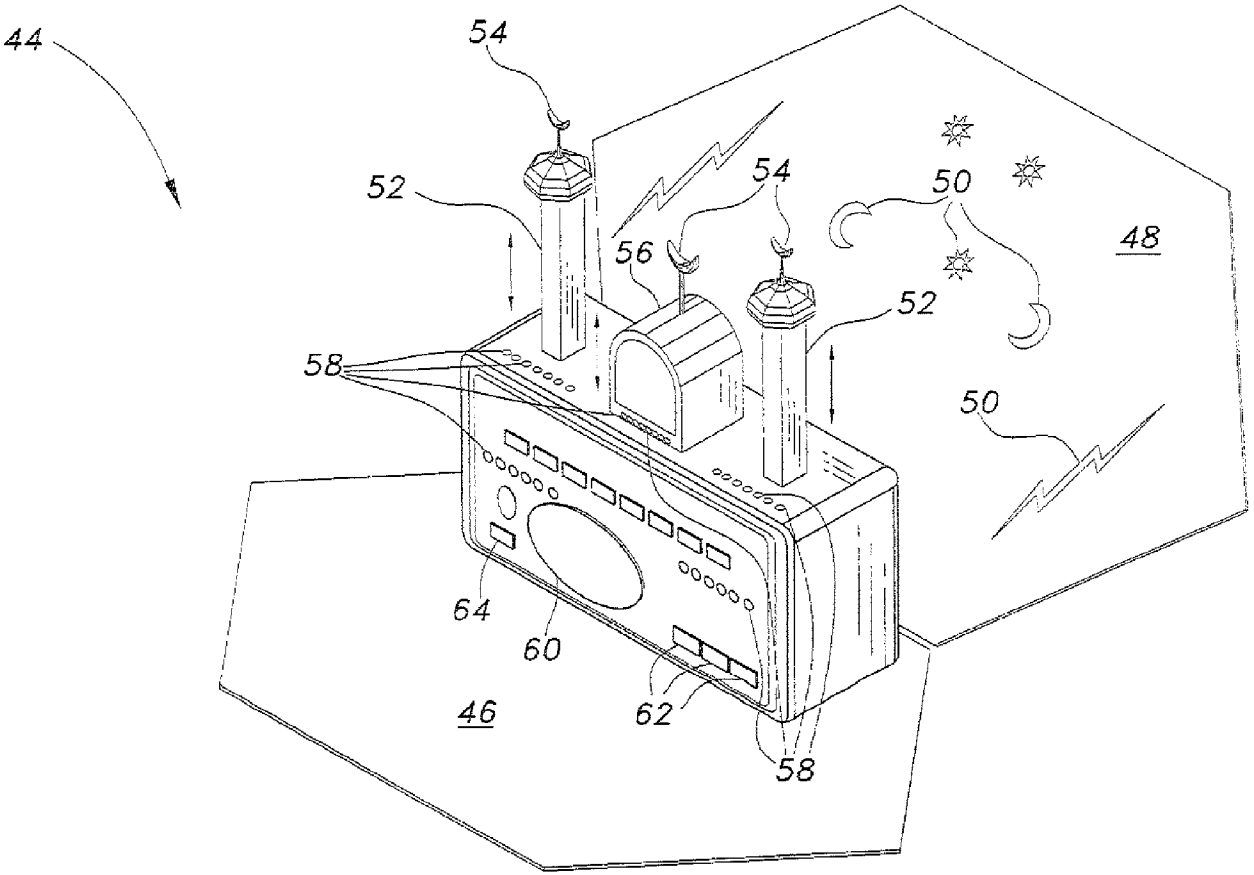
FIG. 3 is a front perspective view of the auxiliary unit of the device for announcing prayer times according to the present invention, illustrating various features thereof.

FIG. 3 provides a perspective view of the auxiliary unit 44 that is located remotely from the base unit 10. The auxiliary unit 44 communicates electronically with the base unit 10 by conventional means, i.e., hard wire or wireless connection. The auxiliary unit 44 is also geographically fixed in reasonably close proximity to the base unit 10, with their mutual proximity providing practical cable or wireless communication between the two units. The auxiliary unit 44 is mounted on a sconce, which may in turn be mounted on an appropriate wall surface. The sconce includes a substantially horizontal base plate 46 and a substantially vertical back plate 48 extending upwardly from the base plate 46. The back plate 48 may include various astronomical and/or astrological signs 50, or other embellishments as desired.

The auxiliary unit 44 provides for the transmission of wireless audio signals to the remote speakers, if the speakers are not hard wired to the output receptacles 32 provided in the back of the base unit 10. The auxiliary unit 44 includes at least one, and preferably two, selectively extendible and retractable transmitter towers 52 extending from the top or upper surface. The transmitter towers 52 are preferably in the form of miniature minarets, serving as a visual symbol of the minarets associated with mosques and traditionally used to call Muslims to prayer. Each of the transmitter towers 52 includes a small transmitter antenna 54 thereon, providing for wireless signal transmission to the remotely located speakers illustrated in FIG. 5 and discussed further below. Conventional extension and retraction mechanisms (not shown), e.g., spiral screw jacks, cable and pulley, pneumatic telescoping cylinders, etc., may be used to selectively extend and retract the transmitter towers 52, as indicated by the generally vertical movement arrows adjacent the towers. Preferably, the extension and retraction mechanisms are driven automatically according to the athan time program, to extend automatically at the appointed time and retract after the transmission has been completed. An additional central transmitter unit 56 also selectively extends and retracts from the top of the auxiliary unit 44 by means of a conventional mechanism, examples of which were cited above for the transmitter towers 52. The central transmitter unit 56 provides low power signals (either hard wired or wireless) to the two transmitter towers 52, with the towers 52 amplifying the signal and transmitting it to the more distant remote speakers.

The front panel of the auxiliary unit 44 includes additional controls and annunciators. A series of lights 58 (LEDs, etc.)

may be provided along the upper surface of the auxiliary unit 44, along the lower front surface or other area of the central transmitter unit 56, and/or along the front surface of the auxiliary unit 44, as desired. These lights 58 may be continuously illuminated, or may be dormant except during athan, as desired. A clock and programming display 60 is provided in the front face of the auxiliary unit 44, for use in programming the device as well as for displaying athan times or other displays as desired. The auxiliary unit 44 may be programmed by conventional means, e.g., pushbuttons 62 or other controls disposed upon the front face, or other means as described immediately below. An on/off switch 64 (e.g., pushbutton, etc.) is also provided on the front face or panel of the auxiliary unit 44.

Figure 4:
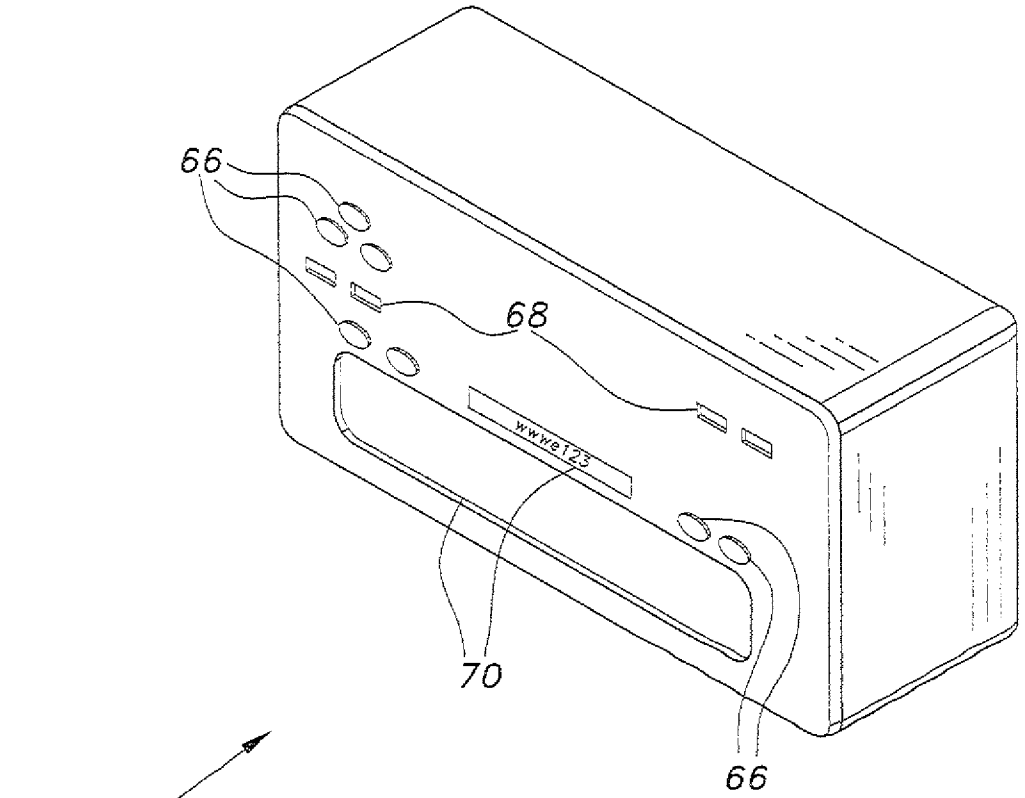
FIG. 4 is a rear elevation view of the auxiliary unit of FIG. 3, illustrating further features thereof.

The opposite rear panel of the auxiliary unit 44 is illustrated in FIG. 4 of the drawings. The rear panel of the auxiliary unit 44 includes additional controls and features, e.g., pushbuttons or other controls 66, additional flash drive and/or RS-232 ports 68 or the like, and additional displays 70 for use during programming of the device, e.g., displays of output signal strength, wireless connection to remote speakers and to the base unit 10, etc. Ordinarily these displays 70 are not visible during normal operation of the system, but they would be visible to an operator setting up or adjusting the system.

Figure 5:
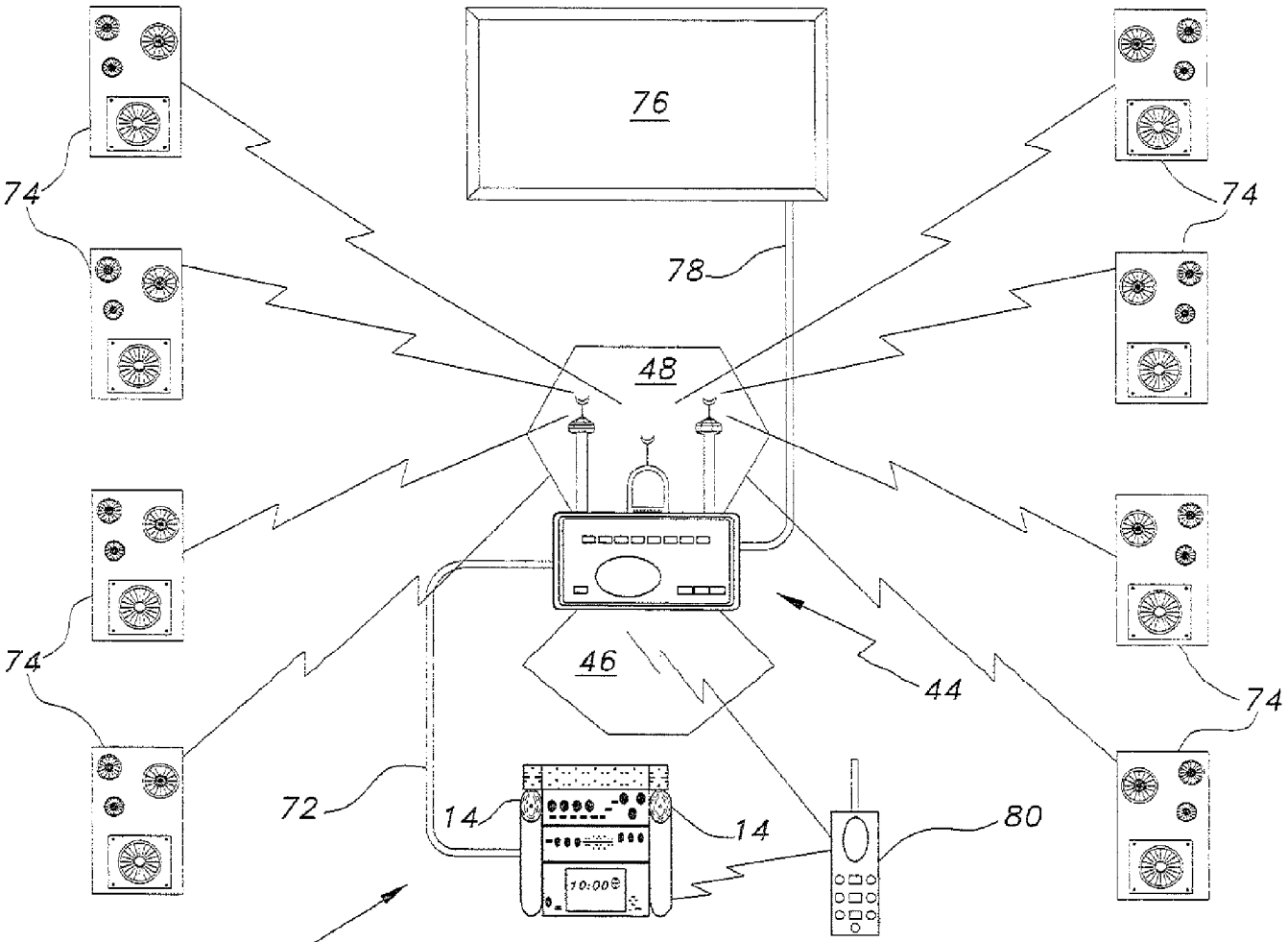
FIG. 5 is a schematic view of the device for announcing prayer times according to the present invention, illustrating its various components and their relationships to one another.

FIG. 5 provides an overview of an exemplary installation of the device for announcing prayer times in accordance with the present invention. The base unit 10 is shown in the lower portion of FIG. 5, and communicates with the auxiliary unit 44 in the central portion of the Fig. by means of a cable 72. Alternatively, the two units 10 and 44 may communicate electronically with one another by wireless means, with cables or cords being needed only for the provision of electrical power to the two units 10 and 44. A series of remotely disposed audio speakers 74 are also shown in FIG. 5. These speakers 74 are separate and distinct from the two speakers or annunciators 14 disposed with the base unit 10. The multiple speakers 74 are preferably located within the same structure or complex as the base and auxiliary units 10 and 44, but remotely at some distance therefrom in order to spread their message throughout the area, e.g., in separate rooms or halls, etc. The speakers 74 receive their electrical power conventionally, but receive their audible signals by wireless means from the transmitters of the auxiliary unit 44. Alternatively, one or more of the speakers 74 may receive their signals by means of wire cables, cords, or the like, in the event that those speakers 74 are located where wireless communication is not practicable from the auxiliary unit 44.

A large scale electronic video display screen 76, e.g., a conventional LED or plasma flat screen, etc., is preferably provided with the system. The video screen 76 is preferably of sufficient size to be visible at some distance away in a large hall or auditorium by a large number of people. The video display screen may be used to provide video output from the DVD player of the base unit 10 (see the disc slot 22 for the base unit 10, in FIG. 1). The video screen 76 may receive its required electrical power and its signal by means of a hard wire cable or cord 78 from the auxiliary unit 44, which in turn receives its power (and signal, if no wireless signal is provided) by means of the cable 72. Alternatively, the screen 76 may receive its power conventionally by means of the cable or cord 78 (or other conventional electrical power source), with its signal being provided by wireless means from the auxiliary unit 44.

The system may be used to provide radio and/or television broadcast output to persons in the area, if so desired. A conventional television broadcast receiver and tuner (not shown) may be disposed with the base unit 10, with the base unit 10 and auxiliary unit 44 adjusted to provide video output to the display screen and audio output to at least the speakers 14 of the base unit 10. The receiver may be configured to receive satellite and/or cable broadcast signals as well, if so desired. Alternatively, additional video screens may be installed in remote areas along with the speakers 74, with the audio signal portion of the broadcast being played through the adjacent speakers 74 where a remote video screen is provided. It will be seen that the system may include a conventional radio receiver (AM and/or FM) in addition to or in lieu of the television receiver noted above, if so desired. The audio or radio signals may be transmitted to the remotely disposed speakers 74 as described further above for the athan announcements and/or other such audio output.

In many instances it is likely that both the base unit 10 and its auxiliary unit 44 will be located in relatively inaccessible areas. This may be due to the need to protect the devices from tampering, and/or due to their being located somewhat inaccessibly in order to provide the required signal transmission to the remotely located speakers 74 and/or video screen 76. As such inaccessible positioning of the base unit 10 and/or its auxiliary unit 44 results in at least some inconvenience for the operator in programming the system, the operator may be provided with a conventional remote programming and control unit 80, as shown in FIG. 5. The remote unit 80 may communicate electronically with the base unit 10 and/or the auxiliary unit 44 by hard wire cable or wireless signal (RF, infrared, ultrasonic, etc.), as desired.

Accordingly, the device for announcing prayer times provides an extremely versatile system capable of providing very accurate athan times in order to meet the needs of devout Muslims anywhere. The system also provides for the local area broadcast (audio and/or video) of various programming, e.g., specialized religious or other announcements and information, commercial broadcast, etc. The system thus fulfills the needs of Muslims and others in innumerable locations throughout the world.

It is to be understood that the present invention is not limited to the embodiments described above, but encompasses any and all embodiments within the scope of the following claims.

I claim:

1. A device for announcing prayer times, comprising:

a geographically fixed base unit;

a programmable electronic device disposed within the base unit, the programmable electronic device having means for input of local geographic location, date, and time, and means for automated output relative of athan times relative to the geographic location, date and time taking into account the angular position of the sun;

a clock and programming display disposed within the base unit;

at least one audible annunciator disposed within the base unit;

programming controls disposed within the base unit;

a wall mounting sconce; and at least one audible speaker disposed remote from the base unit, the at least one audible speaker communicating electronically with the base unit.

2. The device for announcing prayer times according to claim 1, further comprising:

a geographically fixed auxiliary unit communicating electronically within the base unit;

at least one transmitter tower retractably extending from the auxiliary unit; and a central transmitter unit retractably extending from the auxiliary unit, the central transmitter unit communicating electronically with the at least one audible speaker by means of the at least one transmitter tower.

3. The device for announcing prayer times according to claim 2, wherein the auxiliary unit being disposed upon the wall mounting sconce.

4. The device for announcing prayer times according to claim 1, wherein/further comprising:

an electronic video player disposed within the base unit; and an electronic video display screen remotely disposed from the base unit, the electronic video display screen communicating electronically with the electronic video player.

5. The device for announcing prayer times according to claim 4 further comprising a television broadcast receiver disposed within the base unit, the television broadcast receiver selectively communicating electronically with the electronic video display screen.

6. The device for announcing prayer times according to claim 1, further comprising a radio broadcast receiver disposed within the base unit, the radio broadcast receiver selectively communicating electronically with the at least one audible annunciator of the base unit and with the at least one audible speaker disposed remotely from the base unit.

7. The device for announcing prayer times according to claim 1, further comprising a remotely disposed programming device selectively communicating electronically with the base unit.

8. A device for announcing prayer times, comprising:

a geographically fixed base unit;

a geographically fixed auxiliary unit communicating electronically with the base unit;

at least one audible speaker remotely disposed from the base unit and the auxiliary unit;

at least one transmitter tower retractably extending from the auxiliary unit;

a wall mounting sconce; and a central transmitter unit retractably extending from the auxiliary unit, the central transmitter unit communicating electronically with the at least one audible speaker.

9. The device for announcing prayer times according to claim 8, further comprising:

a programmable electronic device disposed within the base unit, the programmable electronic device having means for input of local geographic location, date, and time, and means for automated output relative of athan times relative to the geographic location, date and time taking into account the angular position of the sun;

a clock and programming display disposed within the base unit;

at least one audible annunciator disposed within the base unit; and programming controls disposed within the base unit.

10. The device for announcing prayer times according to claim 8, wherein the auxiliary unit being disposed upon the wall mounting sconce.

11. The device for announcing prayer times according to claim 8, further comprising:

an electronic video player disposed within the base unit; and an electronic video display screen remotely disposed from the base unit, the electronic video display screen communicating electronically with the electronic video player.

12. The device for announcing prayer times according to claim 11, further comprising a television broadcast receiver disposed within the base unit, the television broadcast receiver selectively communicating electronically with the electronic video display screen.

13. The device for announcing prayer times according to claim 8, further comprising a radio broadcast receiver disposed within the base unit, the radio broadcast receiver selectively communicating electronically with the at least one audible speaker disposed remotely from the base unit.

14. The device for announcing prayer times according to claim 8, further comprising a remotely disposed programming device selectively communicating electronically with the base unit.

15. A device for announcing prayer times, comprising:

a geographically fixed base unit;

a programmable electronic device disposed within the base unit, the programmable electronic device having means for input of local geographic location, date, and time, and means for automated output relative of athan times relative to the geographic location, date and time taking into account the angular position of the sun;

a clock and programming display disposed within the base unit;

programming controls disposed within the base unit;

an electronic video player disposed within the base unit;

an electronic video display screen remotely disposed from the base unit, the electronic video display screen communicating electronically with the electronic video player;

at least one audible annunciator disposed within the base unit;

at least one audible speaker disposed remotely from the base unit, the at least one audible speaker communicating electronically with the base unit a geographically fixed auxiliary unit communicating electronically with the base unit;

at least one transmitter tower retractably extending from the auxiliary unit;

a central transmitter unit retractably extending from the auxiliary unit, the central transmitter unit communicating electronically with the at least one audible speaker;

a television broadcast receiver disposed within the base unit, the television broadcast receiver selectively communicating electronically with the electronic video display screen;

at least one audible annunciator disposed within the base unit;

at least one audible speaker disposed remotely from the base unit; and a radio broadcast receiver disposed within the base unit, the radio broadcast receiver selectively communicating electronically with the at least one audible annunciator of the base unit and with the at least one audible speaker disposed remotely from the base unit; and a remotely disposed programming device selectively communicating electronically with the base unit.

16. The device for announcing prayer times according to claim 15 further comprising a wall mounting sconce, the auxiliary unit being disposed upon the wall mounting sconce.

* * * * *